US012359834B2

(12) United States Patent
Ferkey et al.

(10) Patent No.: US 12,359,834 B2
(45) Date of Patent: Jul. 15, 2025

(54) SYSTEM AND METHOD FOR HVAC FAN CONTROL

(71) Applicant: RESEARCH PRODUCTS CORPORATION, Madison, WI (US)

(72) Inventors: Wade Ferkey, Madison, WI (US); Stephen Moon, Madison, WI (US)

(73) Assignee: Research Products Corporation, Madison, WI (US)

( * ) Notice: Subject to any disclaimer, the term of this patent is extended or adjusted under 35 U.S.C. 154(b) by 239 days.

(21) Appl. No.: 18/087,472

(22) Filed: Dec. 22, 2022

(65) Prior Publication Data

US 2023/0213233 A1 Jul. 6, 2023

Related U.S. Application Data

(60) Provisional application No. 63/296,307, filed on Jan. 4, 2022.

(51) Int. Cl.

| | |
|---|---|
| ***F24F 11/72*** | (2018.01) |
| ***F24F 11/00*** | (2018.01) |
| ***F24F 11/80*** | (2018.01) |
| ***F24F 110/10*** | (2018.01) |
| ***F24F 110/20*** | (2018.01) |

(52) U.S. Cl.

CPC ..... *F24F 11/72* (2018.01); *F24F 11/0001* (2013.01); *F24F 11/80* (2018.01); *F24F 2110/10* (2018.01); *F24F 2110/20* (2018.01)

(58) Field of Classification Search

CPC ..... F24F 11/72; F24F 11/0001; F24F 11/80; F24F 2110/10

See application file for complete search history.

(56) References Cited

U.S. PATENT DOCUMENTS

| | | | | |
|---|---|---|---|---|
| 3,724,535 | A | 4/1973 | Sapir | |
| 4,993,629 | A * | 2/1991 | Wylie | F24F 8/10 236/11 |
| 5,000,381 | A | 3/1991 | Mueller et al. | |
| 6,514,138 | B2 | 2/2003 | Estepp | |
| 2009/0114731 | A1 | 5/2009 | Perry | |
| 2012/0085831 | A1 | 4/2012 | Kopp | |
| 2012/0248207 | A1* | 10/2012 | Drake | F24F 11/46 236/51 |
| 2016/0048142 | A1* | 2/2016 | Chan | G05B 19/0428 700/276 |

(Continued)

FOREIGN PATENT DOCUMENTS

| | | | |
|---|---|---|---|
| JP | 2009127965 | A * | 6/2009 |
| WO | WO-2009/100052 | | 8/2009 |
| WO | WO-2016157675 | A1 * | 10/2016 |

OTHER PUBLICATIONS

International Search Report and Written Opinion dated May 8, 2023 for international application PCT/US2022/053869.

*Primary Examiner* — Kun Kai Ma

(74) *Attorney, Agent, or Firm* — Foley & Lardner LLP

(57) ABSTRACT

An HVAC system includes a first air quality sensor and a second air quality sensor. The system contains a controller which calculates a differential between the first air quality sensor and the second air quality sensor. The differential is compared to a threshold. If the threshold is satisfied, a fan is engaged which may, reducing the air quality differential as sensed by the first and second air quality sensor.

17 Claims, 4 Drawing Sheets

(56) References Cited

U.S. PATENT DOCUMENTS

| | | | | |
|---|---|---|---|---|
| 2016/0327286 | A1* | 11/2016 | Flynn | F24F 11/63 |
| 2017/0219236 | A1 | 8/2017 | Sullivan et al. | |
| 2017/0268797 | A1 | 9/2017 | Mowris et al. | |
| 2018/0216843 | A1* | 8/2018 | Zhou | F24F 11/56 |
| 2020/0292190 | A1* | 9/2020 | Gillette | F24F 11/30 |
| 2021/0140700 | A1* | 5/2021 | Hobson | F24F 3/065 |

* cited by examiner

SYSTEM AND METHOD FOR HVAC FAN CONTROL

CROSS-REFERENCE TO RELATED APPLICATIONS

The present application claims priority to U.S. Provisional Patent Application No. 63/296,307, filed Jan. 4, 2022, the entire contents of which are incorporated herein by reference.

BACKGROUND

The present application relates generally to the field of HVAC fan control. More specifically, the present disclosure relates to systems, methods, and devices for providing higher efficiency control of air parameters (e.g., temperature, humidity, etc.) using fan recirculation.

SUMMARY

One embodiment of the disclosure is an HVAC system that includes a plurality of temperature sensors configured to detect (e.g., measure, infer, sense, etc.) the temperature of an area, such as a room within a structure. The HVAC processor is configured to compute a temperature differential between at least two areas. The processor may then compare the temperature differential to a threshold differential. Once the processor detects that the threshold is satisfied, it may activate a fan.

Another embodiment of the present disclosure is a method that includes sensing a set of temperatures corresponding to a plurality of areas; calculating a temperature differential between at least two of the areas; comparing the temperature differential to a threshold differential; and engaging a fan based on the satisfaction of the threshold.

Yet another embodiment of the present disclosure is an HVAC controller device configured to receive temperature measurements sensed by a temperature sensor for a plurality of areas. The controller, via a processor, is also configured to calculate the temperature differential between at least two areas, determine whether the temperature differential(s) satisfy a threshold, and generate an output signal to engage a fan based on this determination.

DETAILED DESCRIPTION

Figure 1:
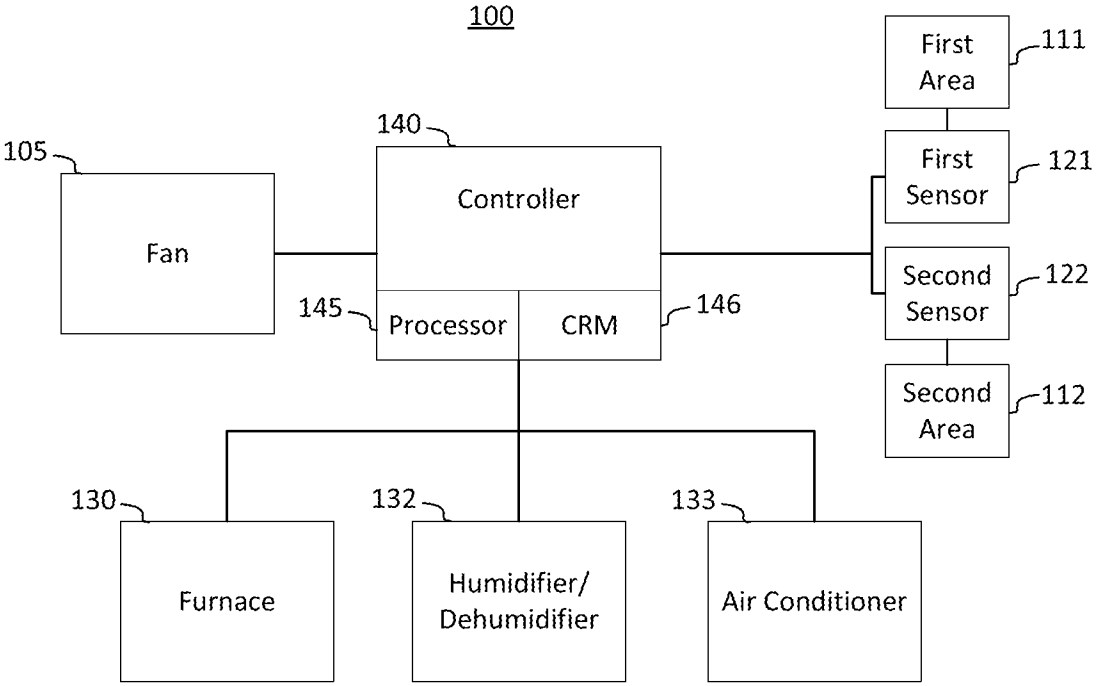
FIG. 1 is a block diagram of an HVAC system according to an embodiment of the present disclosure.

Many structures include heating, ventilation and/or air conditioning ("HVAC") systems capable of controlling air quality parameters, such as temperature, humidity, or particulate count. However, certain HVAC systems are unable to provide consistent air quality to all areas of a structure that they serve, sometimes resulting in undesired air parameter stratification—the unwanted variation of air quality parameters throughout the space served by an HVAC system. For example, a bedroom at the end of a heating duct may receive less heating and humidification than another bedroom closer to a HVAC fan. A poorly insulated room may maintain a lower temperature than another room, particularly a room with a heat source, (such as an oven or sun-facing windows). In addition, a room with its own air purification system may maintain a lower particulate count than an adjacent room with an open window. Although some systems (sometimes termed "zone control" systems) may be capable of controlling the temperature of a plurality of areas within a structure, such as by the use of dampers within ductwork, such systems may increase the cost and complexity of a system, and may be impractical to retrofit to certain existing systems.

As used herein, the term "fan" refers to any fluid driver configured to circulate air through an associated HVAC system (e.g., a blower motor, etc.). The term "air-conditioning" refers to any system which cools air (e.g., evaporative coolers, compressor-based air-cooling, refrigeration, thermo-electric cooling, etc.). A "call for cool(ing)" refers to a request to engage an air conditioner. A "furnace" refers to any method of heating (e.g., natural gas, oil, resistive-electric, heat pumps, etc.). A call for heat(ing) refers to a request to engage a furnace. HVAC system refers to any system with at least one of a furnace or an air conditioner (e.g., an air conditioning system installed in a tropical climate which may lack a heating feature is nonetheless an HVAC system).

In general, disclosed herein are systems for managing indoor air to reduce undesirable air parameter stratification. In one embodiment, the system is concerned with undesirable temperature stratification within a structure. Other embodiments may be concerned with one or more alternate (or additional) air quality parameters (e.g., humidity, pollen count, etc.). In an embodiment, the temperature is sensed from two temperature sensors, each located in a separate area (e.g., a room, floor, etc.) within the structure. The temperature sensors are communicatively coupled to a controller (e.g., via a wired or wireless network, analog or digital input, etc.), and transmit a temperature associated with their respective areas to the controller. The controller includes a processor, which calculates a temperature differential between the areas, and compares the differential to a threshold differential. In an embodiment, the threshold is satisfied based on a fixed symmetric threshold differential of at least 5° (i.e., the threshold is based on the 5° magnitude of the temperature difference between two areas, without regard to which area is warmer/cooler). For example, if the measured temperatures of the respective areas differ by at least 5°, the threshold may be satisfied. In response to determining that the threshold is satisfied, the controller may, directly or through intermediate components or devices, engage a fan to circulate air throughout the structure, thereby mixing the air and reducing the associated temperature stratification between the areas. While alternate embodiments may use other criteria to disengage the fan (such as the completion a fixed time of operation, or a return to a sub-5° temperature differential between the areas, which, advantageously, may simplify system operation or avoid persistent fan operation), a first embodiment utilizes a hysteresis, disengaging the fan once the temperature differential between the areas is reduced below 3°, which may advantageously, reduce wear due to startup cycles of the fan, and minimizes changes in fan state which may be acoustically unpleasant. Advantageously, the disclosure may improve occupant comfort by reducing undesirable stratification of air quality, while tolerating or encouraging desirable stratification in air quality. Such a system may be realized at a lower installation cost than other (e.g., "zone control") systems, particularly when implemented as a retrofit to an existing system, and may also minimize system complexity and moving parts which may lead to increased reliability and decreased maintenance. In still further embodiments, the foregoing concepts may be utilized with HVAC systems that have zone control systems such that fan control and air mixing may be focused on one or more desired zones to the exclusion of other zones such that air parameter de-stratification is accomplished within the one or more desired zones (and not all areas of a building. Moreover, the embodiment may lower operating costs, and lower a carbon footprint relative to a traditional HVAC system.

FIG. 1 is a block diagram of an HVAC system 100 according to an embodiment of the present disclosure. The HVAC system 100 may be installed in a residential home, a commercial property, or any other structures for which automated control of one or more air quality parameters is desired. The HVAC system 100 includes a fan 105 capable of transferring or circulating air between a plurality of areas, e.g., a first area 111 and a second area 112. Other embodiments may contain additional areas. In some embodiments (e.g., in a home with two bedrooms with closed doors, and minimal direct airflow between them), the fan 105 may be disposed within and/or coupled to ductwork or other components for transferring air between a plurality of areas, and its operation may principally rely on such means to transfer or circulate air between the areas. In other embodiments (e.g., where the first area 111 and the second area 112 correspond to sections in a large concert hall or a great room in a home), the circulation or transfer of air may principally rely on air currents directly between the areas, without regard to whether the fan 105 is disposed within and/or coupled to ductwork or other components for transferring air between a plurality of areas. In some embodiments (e.g., those concerned with pollen or other particulate count), the routing of air through ductwork or similar constricted passages may allow for air filtering which may, advantageously, improve the overall air quality in excess of what could be realized by recirculation alone. Other embodiments may forgo such filtering/constricting, which may advantageously increase a flow rate realized from a given fan 105. In still further embodiments, HVAC system 100 may include a zoning system having one or more dampers (including return and/or supply dampers) to independently control airflow to or from (and thereby conditioning of air within) particular zones of a building according to sensed conditions within the respective zones. Such an embodiment may include any number of zones and/or dampers and may further include any number of wireless sensors (e.g., temperature, humidity, air quality sensors) and/or controllers (e.g., thermostats, humidistats, etc.) within each zone to analyze air parameters and determine air parameter stratification within a particular zone (e.g., air stratification between different areas of a particular zones) as well as within a zone as compared to the rest of the building (e.g., air stratification between a particular zone and one or more other areas or zones of the building).

Further disclosed are multiple sensors, e.g., a first sensor 121 and a second sensor 122. In other embodiments, any number of sensors may be used as noted above. A first sensor 121 may be disposed within a first area 111, to measure the first area's 111 air quality (e.g., ambient temperature, such as by a thermistor or by any other means known to those in the art). Alternatively, the first sensor 121 may be disposed outside of a first area 111 and measure its air quality (e.g., remotely measure the area's temperature such as through an infrared sensor, or by any other means familiar to those in the art). These sensors (e.g., the first temperature sensor 121) are communicatively coupled to a controller 140, which is also communicatively coupled to the fan 105 so that the sensed information can impact fan 105 operation. The controller may also be communicatively coupled to a furnace 130, an air conditioner 133, and a humidifier/dehumidifier 132, so that various sensors may result in adjustments to other air quality parameters. In some embodiments, an air quality parameter may be calculated or inferred, (e.g., the first sensor 121 may measure the temperature within the first area 111, and the second sensor 122 may measure the temperature within an air return duct; the information may allow the controller 140 to infer or calculate a temperature of the second area 112). The controller 140 enables a processor to interface with a variety of HVAC system 100 components. For example, controller 140 may include an interface with a furnace 130 to call for heating, an interface with an air conditioner 133 to call for cooling, and an interface with a humidification and/or dehumidification device 132 in order to call for humidity adjustments. The controller may also monitor set-points, and operate the furnace 130, humidifier/dehumidifier 132, and other HVAC system components to maintain these set-points. A set-point may be any maximum, minimum value for an air quality parameter. For example, a set point may be a minimum temperature (e.g., 18° C., 50° F., etc.), a maximum humidity (e.g., 65% RH), etc. The controller 140 may, for example, activate an air conditioner 133 based on a sensed temperature exceeding a set point, where no undesirable air quality stratification is present. The controller 140 may also include alarm/indicator lights, a network interface, a disk drive, a computer memory device, etc. The HVAC system may have one or more output interfaces that use the same or a different interface technology.

Computer-readable medium 146 is an electronic holding place or storage for information so that the information can be accessed by the processor 145 as known to those skilled in the art. Computer-readable medium 146 can include, but is not limited to, any type of random access memory (RAM), any type of read only memory (ROM), any type of flash memory, etc. such as magnetic storage devices (e.g., hard disk, magnetic strips, . . . ), smart cards, flash memory devices, etc. The HVAC system may have one or more computer-readable media that use the same or a different memory media technology. The HVAC system 100 may have one or more drives that support the loading of a memory medium such as a CD, a flash memory card, etc.

Processor 145 executes instructions as known to those skilled in the art. The instructions may be carried out by a special purpose computer, logic circuits, or hardware circuits. Thus, processor 145 may be implemented in hardware, firmware, software, or any combination of these methods. The term "execution" includes the process of running an application or the carrying out of the operation called for by an instruction. The instructions may be written using one or more programming language, scripting language, assembly language, etc. Processor 145 executes an instruction, meaning that it performs the operations called for by that instruction. Processor 145 operably couples with input interfaces (e.g., air quality sensors), output interface (e.g., furnace control signals which communicates a request for heating to the furnace 130), computer-readable medium 146, controller application, etc. to receive, to send, and to process information and to control the operations of the HVAC system 100. Processor 145 may retrieve a set of instructions from a permanent memory device such as a ROM device and copy the instructions in an executable form to a temporary memory device that is generally some form of RAM. The HVAC system 100 may include a plurality of processors that use the same or a different processing technology. In an illustrative embodiment, the instructions may be stored in computer-readable medium 146. In some embodiments, the controller 140 may be a thermostat.

In some embodiments, the temperature sensors may be operated by a third party, such as the National Oceanic and Atmospheric Administration, and communicatively coupled to the controller 140 by any method (e.g., via a wired or wireless network, analog or digital input, etc.). In some embodiments, the system may be configured to "learn" (e.g., record how the recirculation of air between areas affects their temperature, and rely on that recording during future operation). For example, if a first area 111 is a small foyer in a home, and a second area 112 is an adjacent great room, the system may record that air recirculation generally results in the first area 111 adopting the second area's 112 conditions, with little effect on the second area 112. Some embodiments may record a large number of such relationships between a plurality of areas which may, beneficially, be used to determine whether the system should call for heating, call for cooling, engage a fan 105, take another action, or take no action. In some embodiments, the system may record disparate results between air quality measures. For example, a system that records minimal equalization of temperature from recirculation may record substantial equalization between humidity, particulate count, etc.

Some embodiments may permit, or even encourage air quality stratification. For example, an occupied area may be desirably warmer (or cooler) than an unoccupied area, in order to ensure occupant comfort, or to avoid allowing plumbed areas to reach freezing temperatures. In some embodiments, the system may encourage stratified air quality to increase energy efficiency, user comfort, etc. For example, if a bedroom is colder than a living space, and a variable energy cost is $0.10/kwh, the system may activate a furnace 130, even where recirculation of air could warm the bedroom adequately. In doing so, the system may accumulate heat in the living space. And when the energy cost rises to $0.25/kwh, the system may use the accumulated heat in the living space to warm the bedroom via recirculation.

The temperature sensors may be located in the same room(s) as the HVAC system 100, or may be located remotely from each other (e.g., in different rooms or areas of a building). Often, these areas may be coextensive with rooms in a structure, however, in many other cases, a room may be subdivided into a plurality of areas, or an area may be desired without regard to, or at least outside of, a structure (e.g., ambient exterior air which may be further subdivided such as between a north facing wall and a south facing wall, or areas may be designated for water or gas lines, ground temperature, a mechanical compartment or component, etc.). As noted above, the furnace 130 refers to any component(s) of the HVAC system used to heat the air. The air conditioner 133 refers to any component(s) of the HVAC system used to cool the air.

Figure 2:
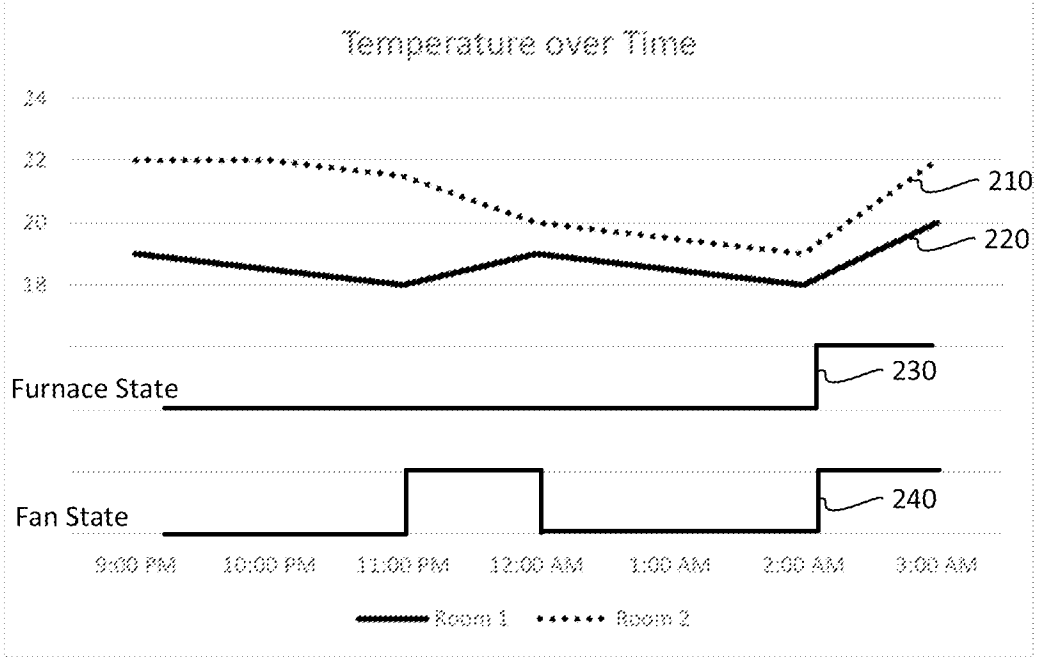
FIG. 2 is a graphical representation of the operational effect of an HVAC system on the temperature of two areas over time according to an embodiment of the present disclosure.

FIG. 2 is a graphical representation of the operational effect of an HVAC system 100 on the temperature of two areas over time according to an embodiment of the present disclosure. The furnace state 230 is represented as a digital signal, with the "high" or "1" value corresponding to the operating state of the furnace 130 and the "low" or "0" state corresponding to the non-operating state of the furnace 130. Similarly, the fan state 240 is represented as a digital signal, with the "high" or "1" value corresponding to the operating state of the fan 105 and the "low" or "0" state corresponding to the non-operating state of the fan 105.

Room 2's temperature 210 is displayed as warmer than room 1's temperature 220, and both gradually decrease throughout the night (such as in response to a lower exterior ambient temperature). At 11:00 PM, room 1's temperature reaches 18°. In order to balance the temperatures between rooms 1 and 2 (and thereby warm room 1), rather than engage the furnace 130, the HVAC system 100 activates a fan 105 to recirculate air between room 1 and room 2. Likewise, in other embodiments, the HVAC system 100 may activate the fan 105 to control temperature and humidity without activating an air conditioner, humidification unit, or dehumidification unit. The activation of the fan raises the temperature of room 1 to 19° by 12:00 AM. At 02:00 AM, when the temperature of room 1 has again reached 18°, the HVAC system may observe that although room 2's temperature 210 is somewhat warmer than room 1's temperature 220, that the temperature differential is inadequate to warm room 1, and may instead engage the furnace 130. In this embodiment, the fan state 240 appears to engage synonymously with the furnace state 230 because, advantageously, the HVAC system 100 corresponding to FIG. 2 may use the fan 105 associated with the furnace 130 as the recirculating fan 105. In some embodiments (e.g., electric baseboard furnaces, underfloor water or electric furnaces, etc.) the operation of a fan 105 may not be necessary during furnace 130 operation or during operation of all HVAC components (such as an A/C unit or other forms of heating) that alter temperature within the corresponding structure. In some embodiments, (e.g., natural gas heating) a fan 105 may start somewhat before or after the furnace 130 begins operation but is nonetheless a part of furnace operation if it is based on the operation of the furnace 130, and not a temperature differential.

Figure 3:
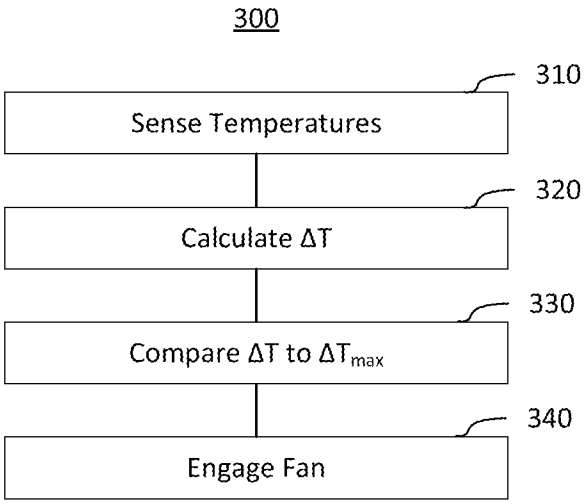
FIG. 3 is flow diagram of a method of climate control within a structure according to an embodiment of the present disclosure.

FIG. 3 is flow diagram of a method 300 of climate control within a structure according to an embodiment of the present disclosure. Although the method may be used with regard to any air quality parameters, this example is directed to one of temperature control. Other embodiments may combine multiple parameters of air quality (e.g., combining temperature and humidity to control perceived temperature). The method 300 may be implemented using the HVAC system 100 of FIG. 1, for example, through a software application implemented by the controller 140. At operation 310, temperatures (or other air parameters such as humidity, pollutant level, etc.) associated with a plurality of areas are sensed (detected, calculated, inferred, etc.). Some embodiments may sense the an ambient air temperature (e.g., by a thermistor or diode), other embodiments may measure a surface temperature associated with the room (e.g., by an infrared sensor), or calculate the temperature based on other data. The temperature data may be conveyed to the controller 140. In some embodiments, this may be performed regularly, such as every second. In other embodiments, this may be performed at the request of the controller 140. In one embodiment, air parameters are sensed within different areas of a building that does not include a zone system. In another embodiment in which a zone system is utilized within the building, air parameters may be sensed in different zones using sensors or controllers associated with each respective zone and may also be sensed within multiple areas of particular zones.

At operation 320, a processor 145 may compute a temperature differential (or air parameter differential including, e.g., humidity, pollutant level, etc.) between at least two of the areas. In some embodiments, this may be a logical subtraction operation by a processor 145 or may require additional computation, such as where a particulate count must be normalized to account for sensor differences. In embodiments in which HVAC system 100 utilizes a zoning system, the differential may be calculated between sensor readings associated with different zones of the home or alternatively between multiple sensor readings within a particular zone.

At operation 330, the processor 145 may then compare the temperature differential (or other air parameter differential) to a threshold differential. In some embodiments, this may be another subtraction operation by a processor 145, in other embodiments, this may require considering several air quality parameters, and several control states to determine a threshold, and may involve communication of a plurality of processors 145 over a network. This comparison may make use of range checking to discard improbable values. For example, if an area's recorded temperature abruptly changes from 20° to −255°, one or more measurements may be discarded. In some embodiments, the threshold may be a fixed symmetrical temperature difference, (e.g.,) 5°. Some embodiments may define the threshold based on an asymmetric temperature difference. For example, if a bedroom area and a living room area exhibit a 5° differential at 1 AM, no action may be taken if the bedroom is 20° and the living room is 15°. However, the embodiment may take action if the temperatures of the bedroom and living room are reversed.

Some embodiments combining multiple criteria to establish a threshold may need to organize that data to calculate a progress towards a threshold. For example, a system considering temperature and humidity may comprise a lookup table, with a value of humidity corresponding to each value of temperature within a range. In this case, progress towards the threshold may be understood as the distance in the lookup table before activation. Some systems may use a points based approach, for example, designing a threshold to equal 1.00 points and contributing points based on temperature differentials, humidity levels, radiant solar energy, etc. For example a system may assign 0.95 points due to a large temperature differential, 0.20 points due to a high energy costs, and −0.05 points due to high radiant solar energy. Such a system may determine the threshold satisfied, because the total point value of 1.2 exceeds the threshold of 1.00. If the threshold is not satisfied, a progress towards the threshold (such as 0.5) may be recorded for analytic, prognostic, or other purposes. The temperature differential required to satisfy the threshold based on a particular set of data is termed the threshold differential. Other systems may define formulae controlling the operation of the fan 105. One skilled in the art will understand that a large number of control system techniques may be applied to the present disclosure.

Some embodiments may also depend on control states, which determine whether a threshold is satisfied based on data other than air quality parameters. For example, an embodiment may determine whether a threshold is satisfied based on a time of day, a sensed occupancy of a structure or area, an energy cost, a state of charge or charging state of a battery, a fill level of an energy source (e.g., oil or propane tank), a season, the location of an individual or mobile device (e.g., to engage an air conditioner when a mobile device is within 20 miles of a structure), etc. Beneficially, such systems may lower energy use or cost, avoid a system failure due to lack of energy, etc. In some cases, multiple control states may contribute, cumulatively, to a threshold; in some circumstances, they may be additive or subtractive (e.g., where a low energy cost or occupancy status would lower a threshold differential by 1° each, the two control states may combine for a 2° reduction in the threshold differential), while in others, they may act as logical operators (e.g., based on an occupancy status, the temperature differential may not be altered, regardless of energy cost). In some embodiments, control state contribution accumulation may depend on complex relationships between several control states (e.g., an algebraic curve relating a distance of a mobile device to a humidity differential may be one of several such curves considered for the threshold).

100271 At operation 340, the system 100 engages a fan 105 based on a determination the threshold has been satisfied. The fan 105 may be engaged without activation of a furnace or air conditioning unit such that the fan 105 will circulate and de-stratify the temperature (or other parameters) of the air throughout the structure. In some embodiments, the fan 105 may be shared with a furnace 130 or otherwise also associated with the HVAC system 100, such as for an air conditioner 133. In other systems, a fan 105 (which may be a subset of a larger plurality of available fans, such as two of three ceiling fans and zero of one blower motor fan) may be engaged based on the temperature differential. In some embodiments, a fan speed may also be determined according to energy or other criteria (e.g., a variable speed fan may be engaged at a low speed to minimize noise/vibration and power use). In embodiments in which HVAC system 100 includes a zoning system, system 100 may selectively open or close dampers associated with particular zones for which air de-stratification is desired according to the threshold comparison operation 330. For example, should the threshold comparison operation 330 reveal a sufficient difference in air parameters between air within a first zone as compared to a second zone, dampers (including either supply or return dampers) may be controller so as to circulate air amongst both zones (or amongst a subset of the total zones such that air within the most stratified zones is mixed). Additionally or alternatively, should the threshold comparison operation 330 reveal a sufficient difference in air parameters between air within different areas of a first zone, dampers (including either supply or return dampers) of HVAC system 100 may be selectively controlled such that air is mixed (and thereby de-stratified) only within the first zone exhibiting the air stratification. By limiting the fan-directed air only to zones exhibiting sufficient parameter stratification, energy savings may be achieved given that air stratification may be more quickly achieved by directing air moved by the fan only to the stratified zones and not to all zones.

Figure 4:
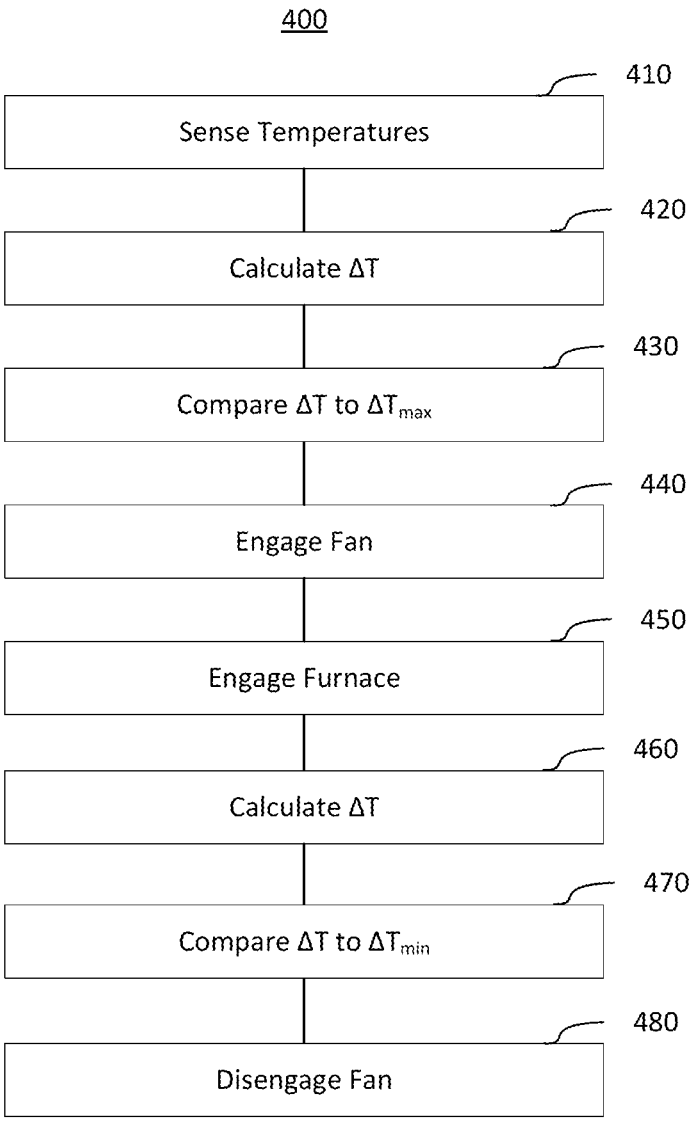
FIG. 4 is another flow diagram of a method of climate control within a structure according to an embodiment of the present disclosure.

FIG. 4 discloses another flow diagram, and an additional method 400 of HVAC fan control. Again, the disclosed method is directed to temperature control for the sake of brevity, though the general method may be practiced to control any other parameter of air quality. As in FIG. 3, an operation 410 is directed to sensing temperatures corresponding to a plurality of areas, such as by an infrared sensor trained on a surface within an area. As also discussed in FIG. 3, such areas may include different zones and/or different areas within particular zones of an HVAC system.

An additional operation 420 is directed to calculating a temperature differential whereby a processor receives the temperature measurement, and determines a differential, such as by subtracting the temperature value of one area from another. A third operation, 430, compares that differential to a threshold, such as by calculating whether the temperature difference exceeds a fixed value threshold. Operation 440 engages a fan based on the satisfaction of that threshold, by the controller 140, such as by enabling of an output signal into a "high" state, which in turn may result in the circulation of air between a plurality of areas. At operation 450, a furnace is engaged in a similar manner based on a determination, by the controller, that the temperature in an area is lower than desired, and may be based on a determination that the threshold of operation 430 is unsatisfied (e.g., because the temperature is not stratified). In some embodiments, the furnace may be engaged based on a minimum set-point relating to a temperature, humidity, energy cost, state of charge of a battery, etc. In some embodiments, the set-point or the threshold may be based on an average (e.g., if one room is 16° and another is 14°, the heater may be engaged based on the average temperature of 15°); in some embodiments, a weighted average may be used (e.g., if a large room has a high humidity level, and a small room has a low humidity level, a dehumidification system may engage based on an overall high humidity level). Some embodiments may operate the fan 105 for a fixed period of operation, such as a fixed time, before operating which may be based on the results of operating the fan for the fixed period. For example, an air conditioner may be engaged after operating a fan for one hour without achieving a desired result, such as the satisfaction of a threshold. Operation 450 may occur prior to, during, or after operation 440. Operation 450 discloses the calculation of an additional temperature differential, which may be based on an updated sensed temperature value produced at operation 410. Operation 470 discloses the comparison of the temperature differential to a second threshold. In some embodiments of the present disclosure, the threshold may be different than the threshold of operation 430 (for example, if energy costs have changed, or if a different threshold temperature differential is desired). Operation 440 discloses the disengagement of the fan, based on the satisfaction of the threshold in operation 470. Some embodiments may complete the operations of method 400 sequentially as disclosed. Other embodiments (or under other conditions) may not. For example, very low temperatures sensed at operation 410 may result in the completion of operation 450 prior to the completion of operation 440. As discussed for FIGS. 1 and 3 above, such fan control and parameter de-stratification operations may be applied to zone systems. Similar zone-specific control may be utilized in accordance with FIG. 4 as discussed above with respect to FIGS. 1 and 3.

In an illustrative embodiment, many of the operations described herein can be implemented at least in part as computer-readable instructions stored on a computer-readable memory. Upon execution of the computer-readable instructions by a processor 145, the computer-readable instructions can cause a computing system to perform the operations.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

It is important to note that the construction and arrangement of the apparatus and control system as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method operations may be varied or re-sequenced according to alternative embodiments. Other substitutions, modifications, changes and omissions may also be made in the design, operating conditions and arrangement of the various exemplary embodiments without departing from the scope of the present application. For example, any element disclosed in one embodiment may be incorporated or utilized with any other embodiment disclosed herein.

What is claimed is:

1. An HVAC system, comprising:

a first temperature sensor configured to detect a first temperature of a first area;

a second temperature sensor configured to detect a second temperature of a second area;

a controller configured to:

calculate a first temperature differential between the first area and the second area;

determine whether a threshold is satisfied based on a comparison of the first temperature differential to a first threshold differential; and responsive to the satisfaction of the threshold, cause activation of a fan to circulate air through the first and second areas; and the fan, wherein the fan is configured to circulate the air through the first and second areas in response to a request from the controller, wherein the first threshold differential is determined based on a control state.

2. The HVAC system of claim 1 wherein:

the first temperature sensor is configured to detect a third temperature of the first area;

the second temperature is configured to detect a fourth temperature of the second area; and the controller is configured to:

calculate a second temperature differential between the first area and the second area, based on the third temperature and the fourth temperature;

compare the second temperature differential to a second threshold differential;

responsive to the second temperature differential failing to satisfy the threshold, maintain a non-operating state of the fan;

compare the third temperature to a set-point; and enable at least one of a furnace or air conditioner, based on the comparison of the third temperature to the set-point.

3. The HVAC system of claim 1 wherein the HVAC system comprises a plurality of zones and a plurality of dampers to control airflow to respective zone of the plurality of zones, and wherein each area corresponds to a respective area within a particular zone of the plurality of zones.

4. The HVAC system of claim 1 wherein the control state is one of a time of day, a sensed occupancy, or an energy cost.

5. The HVAC system of claim 1 wherein the controller is configured to:

receive a first control state value;

determine a progress towards the threshold based on calculating the second threshold differential based on the first control state value, and comparing a second temperature differential to the first threshold differential;

receive a second control state value; and determine that the threshold has been satisfied based on a calculation of the first threshold differential, based on a cumulative contribution of the first and second control state values, and based on comparing the first temperature differential to the first threshold differential.

6. The HVAC system of claim 1 wherein the threshold is determined based on a humidity level.

7. A method of climate control comprising:

sensing a first set of temperatures of a plurality of areas;

calculating a first temperature differential between the first set of temperatures;

comparing the first temperature differential to a first threshold differential; and engaging a fan based on a comparison of the first temperature differential to the first threshold differential;

sensing a second set of temperatures at the plurality of areas while the fan is engaged;

calculating a second temperature differential between the second set of temperatures;

comparing the second temperature differential to a second threshold differential; and disengaging the fan based on the comparison of the second temperature differential to the second threshold differential.

8. The method of claim 7, further comprising calling for heating or calling for cooling based on at least one of:

an average temperature of the plurality of areas; or the completion of a fixed period of fan operation which fails to satisfy a temperature set-point in at least one of the plurality of areas.

9. The method of claim 7 wherein engaging the fan depends on a control state wherein the control state is one of a time of day, a sensed occupancy, or an energy cost.

10. The method of claim 7 wherein the first threshold differential is determined based on a particulate count.

11. A method of climate control comprising:

sensing a first set of temperatures of a plurality of areas;

calculating a first temperature differential between the first set of temperatures;

comparing the first temperature differential to a first threshold differential; and engaging a fan based on a comparison of the first temperature differential to the first threshold differential, wherein the first threshold differential is determined based on at least one of a humidity level or a particulate count.

12. An HVAC controller comprising a non-transitory computer-readable medium having instructions stored thereon; and a processor configured to execute the instructions to:

receive a first temperature measurement from a first temperature sensor of a first area;

receive a second temperature measurement from a second temperature sensor of a second area;

calculate a first temperature differential between the first area and the second area;

determine whether the first temperature differential satisfies a threshold based on a comparison of the first temperature differential to a first threshold differential;

generate a first control signal to enable a fan, based on the satisfaction of the threshold;

receive a third temperature measurement of the first area from the first temperature sensor;

receive a fourth temperature measurement of the second area from the second temperature sensor;

calculate a second temperature differential between the first area and the second area, based on the third temperature and the fourth temperature;

compare the second temperature differential to a second threshold differential;

responsive to the second temperature differential failing to satisfy the threshold, maintain the first control signal in a non-operating-state;

compare the third temperature to a set-point; and output a second control signal, based on the comparison of the third temperature to the set-point, to a furnace or air conditioner.

13. The HVAC controller of claim 12 wherein the controller is not configured to activate a furnace or an air conditioner.

14. The HVAC controller of claim 12 wherein the threshold is based on a control state.

15. The HVAC controller of claim 14 wherein the control state is one of a time of day, a sensed occupancy, or an energy cost.

16. The HVAC controller of claim 14 wherein the controller is configured to:

receive a first control state value;

determine a progress towards the threshold based on calculating a second threshold differential based on the first control state value, and comparing a second temperature differential to the first threshold differential;

receive a second control state value; and determine that the threshold has been satisfied based on a calculation of the first threshold differential, based on a cumulative contribution of the first and second control state values, and comparing the first temperature differential to the first threshold differential.

17. The HVAC controller of claim 12 wherein the threshold is based on a humidity level.

* * * * *